US008276713B2

(12) United States Patent
Yang et al.

(10) Patent No.: US 8,276,713 B2
(45) Date of Patent: Oct. 2, 2012

(54) METHOD OF BUILDING LIQUID TANK USING MOVABLE SCAFFOLDING

(75) Inventors: Young Myung Yang, Seongnam-si (KR); Seong Ho Hong, Seongnam-si (KR); Ihn Soo Yoon, Seongnam-si (KR); Young Chul Yang, Seongnam-si (KR); Heung Seok Seo, Seongnam-si (KR); Ji Hun Kim, Seongnam-si (KR); Byoung Taek Oh, Seongnam-si (KR); Young Kyun Kim, Seongnam-si (KR)

(73) Assignee: Korea Gas Corporation (KR)

( * ) Notice: Subject to any disclaimer, the term of this patent is extended or adjusted under 35 U.S.C. 154(b) by 911 days.

(21) Appl. No.: 11/682,134

(22) Filed: Mar. 5, 2007

(65) Prior Publication Data

US 2007/0205050 A1 Sep. 6, 2007

(30) Foreign Application Priority Data

Mar. 3, 2006 (KR) ..... 10-2006-0020541
Jul. 20, 2006 (KR) ..... 10-2006-0068191

(51) Int. Cl.
*E04G 3/00* (2006.01)

(52) U.S. Cl. ..... 182/36; 182/39; 182/128; 182/141; 182/142; 182/150; 104/307; 187/240; 187/241; 187/244

(58) Field of Classification Search ..... 182/36, 182/128, 141, 142, 150, 39; 104/94, 95, 104/124, 125, 307, 138.1, 138.2; 187/239, 187/240, 241, 244
See application file for complete search history.

(56) References Cited

U.S. PATENT DOCUMENTS 549,936 A * 11/1895 Rush ..... 104/138.1
1,142,806 A * 6/1915 Fenton ..... 182/13
1,974,572 A * 9/1934 Laflin ..... 182/13
2,364,547 A * 12/1944 Olsen ..... 187/244
2,902,110 A * 9/1959 Eickholdt ..... 182/13
3,318,414 A 5/1967 Meek
3,340,960 A * 9/1967 Wilson ..... 182/39
3,420,332 A * 1/1969 Textor ..... 182/128
(Continued)

FOREIGN PATENT DOCUMENTS

CH 377065 A 4/1964
(Continued)

OTHER PUBLICATIONS

Office Action dated Jan. 5, 2010 of corresponding Japanese Patent Application No. 2007-051479—3 pages.

(Continued)

*Primary Examiner* — Katherine W Mitchell
*Assistant Examiner* — Colleen M Chavchavadze
(74) *Attorney, Agent, or Firm* — Knobbe Martens Olson & Bear, LLP

(57) ABSTRACT

Disclosed is a scaffold installed within a large structure such as a pressure vessel or a tank of a ship, and an insulation system construction method using the same. The scaffold for use in performing desired work within a large structure includes a supporting structure installed adjacent to both side surfaces and a top surface of the large structure, and a carrying unit installed movable along the supporting structure to allow materials to be carried or to provide a working space for a worker thereon, wherein the supporting structure is installed to be movable along a wall surface of the large structure.

32 Claims, 8 Drawing Sheets

U.S. PATENT DOCUMENTS

| | | | | | |
|---|---|---|---|---|---|
| 3,508,497 | A | * | 4/1970 | Matsukata | 104/138.1 |
| 3,601,158 | A | * | 8/1971 | Edwards | 138/106 |
| 3,669,026 | A | * | 6/1972 | Mouritzen | 104/118 |
| 3,786,929 | A | | 1/1974 | Hathcock, Jr. | |
| 3,792,758 | A | * | 2/1974 | Wentz | 187/236 |
| 3,822,000 | A | * | 7/1974 | Maeda | 182/82 |
| 3,870,122 | A | * | 3/1975 | Faucheux | 182/36 |
| 3,896,736 | A | | 7/1975 | Hamy | |
| 3,941,267 | A | * | 3/1976 | Greeson | 414/660 |
| 3,960,242 | A | * | 6/1976 | Saxonmeyer | 182/36 |
| 3,998,292 | A | * | 12/1976 | Holterbosch | 182/128 |
| 4,004,654 | A | | 1/1977 | Hamy | |
| 4,232,759 | A | * | 11/1980 | Jacobs | 182/39 |
| 4,257,491 | A | * | 3/1981 | Presnall et al. | 182/142 |
| 4,417,542 | A | * | 11/1983 | Bellafiore | 118/306 |
| 4,483,033 | A | * | 11/1984 | Gebert | 15/3 |
| 4,512,258 | A | * | 4/1985 | Matsukata | 104/138.1 |
| 4,668,301 | A | * | 5/1987 | Takigawa et al. | 134/6 |
| 4,821,845 | A | * | 4/1989 | DeViaris | 187/245 |
| 4,899,847 | A | * | 2/1990 | Lufkin | 182/13 |
| 5,007,501 | A | * | 4/1991 | Baston | 182/128 |
| 5,159,993 | A | | 11/1992 | St-Germain | |
| 5,275,111 | A | * | 1/1994 | Saviccevic | 104/138.1 |
| 5,586,513 | A | | 12/1996 | Jean et al. | |
| 5,613,573 | A | | 3/1997 | L'Hermine | |
| 5,685,392 | A | * | 11/1997 | Phillips et al. | 182/131 |
| 5,701,704 | A | * | 12/1997 | Landes | 52/64 |
| 5,823,291 | A | * | 10/1998 | Goldbach | 182/141 |
| 5,836,423 | A | * | 11/1998 | Kunczynski | 187/245 |
| 6,035,795 | A | | 3/2000 | Dhellemmes et al. | |
| 6,102,157 | A | * | 8/2000 | Goldbach et al. | 182/128 |
| 6,227,330 | B1 | | 5/2001 | Preusser et al. | |
| 6,378,722 | B1 | | 4/2002 | Dhellemmes et al. | |
| 6,431,078 | B2 | * | 8/2002 | Serrano | 104/91 |
| 6,659,226 | B2 | * | 12/2003 | Sarrazy | 182/128 |
| 6,675,731 | B2 | | 1/2004 | Dhellemmes | |
| 7,025,656 | B2 | * | 4/2006 | Bailey | 446/444 |
| 7,575,407 | B2 | | 8/2009 | Tsujimoto | |
| 2002/0040829 | A1 | | 4/2002 | Sarrazy | |
| 2007/0056676 | A1 | * | 3/2007 | Vogt | 156/71 |

FOREIGN PATENT DOCUMENTS

| | | | |
|---|---|---|---|
| JP | 50-033633 | | 3/1975 |
| JP | 55-071688 | U | 5/1980 |
| KR | 174764 | B1 | 11/1998 |
| KR | 1020000011346 | A | 2/2000 |
| KR | 1020000011347 | A | 2/2000 |
| WO | 2005/003516 | A2 | 1/2005 |

OTHER PUBLICATIONS

European Search Report dated Jan. 18, 2012 of corresponding European Patent Application No. 07103446.6—7 pages.

* cited by examiner

METHOD OF BUILDING LIQUID TANK USING MOVABLE SCAFFOLDING

CROSS-REFERENCE TO RELATED APPLICATION

This application claims priority to and the benefit of Korean Patent Application Nos. 10-2006-0020541, filed Mar. 3, 2006, and 10-2006-0068191, filed Jul. 20, 2006, the disclosures of which are incorporated herein by reference in their entirety. This application is related to and incorporates herein by reference the entire contents of the following concurrently filed applications:

| Title | Filing Date | Application No. |
|---|---|---|
| LIQUID TANK BUILDING SYSTEM USING MOVABLE SCAFFOLDING | Mar. 5, 2007 | 11/682,097 |
| MOVABLE SCAFFOLDING AND LIQUID TANK BUILDING USING THE SAME | Mar. 5, 2007 | 11/682,185 |

BACKGROUND

1. Field

The present invention relates to a scaffolding, and more particularly, to a scaffolding for use in building a structure, such as a tank.

2. Discussion of the Related Technology

In general, liquefied natural gas ("LNG") is obtained by causing natural gas, one of fossil fuels, to be liquefied. An LNG storage tank is classified into a ground storage tank which is installed on the ground or buried in the ground, a mobile storage tank which is installed on a transportation means such as automobiles and ships, and the like, according to installation positions.

The aforementioned LNG is stored in a cryogenic state and is explosive when it is exposed to the impact. Thus, the LNG storage tank should be constructed such that the impact resistance and liquid-tight characteristics thereof can be firmly maintained. The LNG storage tank installed on a moving automobile or ship is slightly different from the ground storage tank with little motion in view of their configurations in that it should take precautions against mechanical stress due to the motion thereof. However, the LNG storage tank, which is installed on a ship and takes precautions against the mechanical stress, can also be used as a ground storage tank. Therefore, the structure of an LNG storage tank installed on a ship will be described herein by way of example.

First, an LNG storage tank installed within an LNG carrier may be classified into an independent tank type and a membrane type. This corresponds to classification according to whether cargo load is applied directly to an insulating material, and detailed descriptions thereof will be hereinafter discussed.

As shown in Table 1, a GT type made in Gaz Transport and a TGZ type made in Technigaz are renamed and used as GTT NO 96-2 and GTT Mark III, respectively, as Gaz Transport (GT) and Technigaz (TGZ) are merged into and renamed as Gaztransport & Technigaz (GTT) in 1995.

TABLE 1

Classification of LNG Storage Tanks

| | Membrane Type | | Independent Type | |
|---|---|---|---|---|
| Item | GTT Mark III | GTT NO 96-2 | MOSS | IHI - SPB |
| Tank Material | SUS 304L | Invar Steel | Al Alloy Steel | Al Alloy Steel |
| thickness | 1.2 mm | 0.7 mm | 50 mm | Max. 30 mm |
| Insulating Material | Reinforced Polyurethane Foam | Plywood Box + Perlite | Polyurethane Foam | Polyurethane Foam |
| thickness | 250 mm | 530 mm | 250 mm | 200 mm |

The structures of the aforementioned GT type and TGZ type tanks are described in U.S. Pat. Nos. 6,035,795, 6,378,722, 5,586,513, U.S. Patent Laid-Open Publication No. 2003-0000949, Korean Patent Laid-Open Publication No. 2000-0011346, and the like. A recent technology for the corner part (edge part) of the LNG storage tank includes "a water-tight and thermally insulating tank with an improved corner structure, built into the bearing structure of a ship" described in Korean Patent Laid-Open Publication No. 2000-0011347. Accordingly, an insulation system installed within a large structure such as an LNG tank of a ship and an insulation system construction method can be explained with reference to the aforementioned patent or patent application.

As described above, a scaffold is set up in order to construct an insulation system within a large structure such as a tank. Here, a scaffold is set up before a large structure is completed, and then provides a sufficient space for workers to have easy access to and to easily perform desired work on the large structure. Such a scaffold is classified into an external scaffold installed outside of a large structure and an internal scaffold installed for the internal construction of a large structure such as a pressure vessel, a tank and a dome. The internal and external scaffolds are slightly different from each other in view of kinds of work, installation structures and the like. FIG. 1 is a schematic view illustrating a state where an exemplary scaffold is installed within a structure. The exemplary scaffold may be the one disclosed in Korean Patent No. 174764.

The discussion in this section is to provide a general background information, and does not constitute an admission of a prior art.

SUMMARY

One aspect of the invention provides a liquid tank building system comprising: an unfinished tank defining an interior space; and a scaffolding located within the interior space, wherein the scaffolding is configured to move within the interior space generally along a first horizontal direction, wherein the scaffolding is configured to be substantially restricted to move within the interior space in a second horizontal direction perpendicular to the first horizontal direction.

In the foregoing system, the unfinished tank may comprise a first sidewall, a second sidewall and a top wall interconnecting the first sidewall and the second sidewall which generally opposes the first sidewall, wherein the first sidewall, the second sidewall and the top wall together define the interior space. The first sidewall may comprise two or more sidewall sections, each of which comprises an interior surface, wherein the interior surfaces are angled with each other. The top wall may comprise two or more top wall sections, each of which comprises an interior surface, wherein the interior surfaces are angled with each other.

Still in the foregoing system, the scaffolding may comprise a first side section, a second side section and a top section, wherein the top section interconnects the first side section and the second side section generally opposing the first side section. Each or either of the first side section and the top section may comprise two or more segments, each of which may extend at an angle with respect to neighboring one thereof. The top section may generally extend in the second horizontal direction. The first side section may be configured to move substantially parallel to an interior surface of the first sidewall when the scaffolding moves in the first horizontal direction. The top section may be configured to move substantially parallel to a surface of the top wall when the scaffolding moves in the first horizontal direction. The scaffolding may comprise a spacer interposed between and engaged with the first side section and the first sidewall, and wherein the spacer may be configured to maintain a distance in the second horizontal direction between the first side section and the first sidewall while the scaffolding moves along the first horizontal direction. The system may comprise a rail extending in the first horizontal direction and fixed to the unfinished tank, wherein the scaffolding is engaged with the rail such that the scaffolding moves in the first horizontal direction without substantial movement with respect to the unfinished tank in the second horizontal direction.

Yet in the foregoing system, the scaffolding may comprise a carrier configured to move a worker or material between the first side section and the top section of the scaffolding. The carrier may be configured to move along the top section in the second horizontal direction. The scaffolding may further comprise a second carrier configured to move a worker or material between the first side section and the top section of the scaffolding. The carrier may be configured to move along a first path and the second carrier is configured to move along a second path substantially parallel to the first path. The first and second paths may be configured such that the carrier can be interposed between the first sidewall and the second carrier. The first side section may comprise two substantially parallely extending portions, and wherein the carrier is configured to be interposed between the two substantially parallely extending portions.

Further in the foregoing system, the scaffolding may comprise a carrier movable along a path generally parallel to an interior surface of one of the first sidewall, the second side wall and the top wall, wherein the carrier may be configured to carry a worker or a material. The first sidewall may comprise an interior surface, wherein the unfinished tank may further comprise a partly assembled structure formed on the interior surface, wherein the partly assembled structure comprises a metallic plate and an insulation material interposed between the metallic plate and the interior surface, wherein the metallic plate comprises a plurality of metallic pieces that are liquid tightly coupled together so as to form the metallic plate. Substantially all of interior surfaces of the first sidewall, the second sidewall and the top wall may be made of metal. The unfinished tank may be located on the ground. The first sidewall, the second sidewall, the top wall and the ground may define the interior wall. The unfinished tank may comprise a bottom wall generally opposing to the top wall and connected to the first sidewall, wherein the first sidewall, the second sidewall, the top wall and the bottom wall may define the interior space.

Another aspect of the invention provides a liquid tank building system comprising: an unfinished tank comprising a bottom metallic wall, a top metallic wall, a first metallic sidewall and a second metallic sidewall, wherein the first sidewall interconnects the bottom wall and the top wall, wherein the second sidewall generally opposes the first sidewall and interconnects the bottom wall and the top wall, wherein the bottom wall, the top wall, the first sidewall and the second sidewall together define an interior space; a rail extending generally in a first horizontal direction and fixed to the unfinished tank; and a scaffolding located within the interior space and comprising a first side section, a second side section and a top section, wherein the top section interconnects the first side section and the second side section, wherein the scaffolding is configured to move along the first horizontal direction while being engaged with the rail. In the foregoing system, the rail may be fixed to the first sidewall or a corner formed by the first sidewall and a neighboring wall thereof. The first side section may comprise two substantially parallely extending portions which extend parallel to each other, and wherein the carrier is configured to be interposed between the two substantially parallely extending portions.

Yet another aspect of the invention provides a movable scaffolding comprising: a first side section; a second side section generally opposing the first side section; a top section interconnecting the first side section and the second side section; a carrier configured to move a worker or material between the first side section and the top section of the scaffolding; and wherein the scaffolding is configured to move generally along a first horizontal direction, wherein the scaffolding is configured to be substantially restricted to move in a second horizontal direction perpendicular to the first horizontal direction.

In the foregoing scaffolding, the scaffolding may further comprise a rail extending generally in the first horizontal direction, wherein the scaffolding may be engaged with the rail so as to slide along the rail while being restricted to move in the second horizontal direction. Each or either of the first side section and the top section may comprise two or more segments, each of which extends at an angle with respect to neighboring one thereof. The carrier may be configured to move along the top section in the second horizontal direction. The scaffolding may further comprise a second carrier configured to move a worker or material between the first side section and the top section of the scaffolding. The carrier may be configured to move along a first path and the second carrier is configured to move along a second path substantially parallel to the first path. The first side section may comprise two substantially parallely extending portions which extend parallel to each other, and wherein the carrier may be configured to be interposed between the two substantially parallely extending portions.

A further aspect of the invention provides a method of building a structure, the method comprising: providing an unfinished structure comprising a first sidewall, a second sidewall and a top wall interconnecting the first sidewall and the second sidewall which opposes the first sidewall, wherein the first sidewall, the second sidewall and the top wall together define a interior space; providing the foregoing movable scaffolding within the interior space; and moving the scaffolding within the interior space generally along a first horizontal direction, wherein the scaffolding is configured to be substantially restricted to move within the interior space in a second horizontal direction perpendicular to the first horizontal direction.

In the foregoing method, the first sidewall may comprise two or more sidewall sections, each of which comprises an interior surface, wherein the interior surfaces are angled with each other. The top wall may comprise two or more top wall sections, each of which comprises an interior surface, wherein the interior surfaces are angled with each other. The first side section may be configured to move substantially parallel to an interior surface of the first sidewall when the scaffolding moves in the first horizontal direction. The top section may be configured to move substantially parallel to an interior surface of the top wall when the scaffolding moves in the first horizontal direction. The scaffolding may comprise a spacer interposed between and engaged with the first side section and the first sidewall, and wherein the spacer may be configured to maintain a distance in the second horizontal direction between the first side section and the first sidewall while the scaffolding moves along the first horizontal direction.

Still in the foregoing method, the scaffolding may further comprise a second carrier configured to move a worker or material between the first side section and the top section of the scaffolding. The carrier may be configured to move along a first path and the second carrier may be configured to move along a second path substantially parallel to the first path. The first and second paths may be configured such that the carrier can be interposed between the first sidewall and the second carrier. The unfinished structure may comprise an unfinished tank. The method may further comprise assembling an interior wall structure on the first sidewall, wherein the interior wall structure may comprise a metallic plate and an insulation material interposed between the metallic plate and the first sidewall, wherein the metallic plate comprises a plurality of metallic pieces that are liquid tightly coupled together so as to form the metallic plate. Interior surfaces of the first sidewall, the second sidewall and the top wall may be substantially metallic.

A still further aspect of the invention provides a method of building a liquid tank, the method comprising: providing an unfinished tank which defines an interior space; providing a scaffolding within the interior space; and moving the scaffolding within the interior space along a first horizontal direction without substantial movement of the scaffolding with respect the unfinished tank in a second horizontal direction perpendicular to the first horizontal direction within the interior space.

In the foregoing method, providing the scaffolding may comprise building the scaffolding within the interior space. The method may further comprise removing the scaffolding from the interior space. The unfinished tank may comprise a first sidewall, a second sidewall and a top wall interconnecting the first sidewall and the second sidewall which generally opposes the first sidewall, wherein the first sidewall, the second sidewall and the top wall together define the interior space. The method may further comprise assembling an interior wall structure on the first sidewall, wherein the interior wall structure may comprise a metallic plate and an insulation material interposed between the metallic plate and the first sidewall, wherein the metallic plate comprises a plurality of metallic pieces that are liquid tightly coupled together so as to form the metallic plate.

Still in the foregoing method, the first sidewall may comprise two or more sidewall sections, each of which comprises an interior surface, wherein the interior surfaces of the two or more sidewall sections are angled with each other. The top wall may comprise two or more top wall sections, each of which comprises an interior surface, wherein the interior surfaces of the two or more top wall sections are angled with each other. The scaffolding may comprise a first side section, a second side section and a top section, wherein the top section interconnects the first side section and the second side section generally opposing the first side section. The first side section or the top section may comprise two or more segments, each of which extends at an angle with respect to neighboring one thereof. The top section may generally extend in the second horizontal direction. The first side section may be configured to move substantially parallel to an interior surface of the first sidewall when the scaffolding moves in the first horizontal direction. The top section may be configured to move substantially parallel to a surface of the top wall when the scaffolding moves in the first horizontal direction. The scaffolding may comprise a spacer interposed between and engaged with the first side section and the first sidewall, and wherein the spacer may be configured to maintain a distance in the second horizontal direction between the first side section and the first sidewall while the scaffolding moves along the first horizontal direction.

Yet in the foregoing method, the method may further comprise providing a rail extending in the first horizontal direction and fixed to the unfinished tank, wherein the scaffolding is engaged with the rail such that the scaffolding moves in the first horizontal direction without substantial movement with respect to the unfinished tank in the second horizontal direction. The scaffolding may comprise a carrier configured to move a worker or material between the first side section and the top section of the scaffolding. The carrier may be configured to move along the top section in the second horizontal direction. The scaffolding may further comprise a second carrier configured to move a worker or material between the first side section and the top section of the scaffolding. The first side section may comprise two substantially parallely extending portions, and wherein the carrier may be configured to be interposed between the two substantially parallely extending portions. The carrier may be configured to move along a first path and the second carrier may be configured to move along a second path substantially parallel to the first path. The first and second paths may be configured such that the carrier can be interposed between the first sidewall and the second carrier.

Further in the foregoing method, the scaffolding may comprise a carrier configured to move a worker or a material along a path generally parallel to an interior surface of one of the first sidewall, the second side wall and the top wall. The unfinished tank may be located on the ground. The first sidewall, the second sidewall, the top wall and the ground may define the interior space. The unfinished tank may comprise a bottom wall opposing to the top wall and connected to the first sidewall, wherein the first sidewall, the second sidewall, the top wall and the bottom wall define the interior space. The first sidewall and the top wall may comprise metallic interior surfaces.

An aspect of the present invention is to provide a scaffold wherein an insulation system can be simply constructed, the scaffold can also be easily installed and/or removed and the working speed and stability thereof can also be improved by improving a method of constructing an insulation system within a large structure, particularly within an LNG tank of a ship, and an insulation system construction method using the same.

An aspect of the present invention provides a scaffold for use in performing desired work within a large structure, comprising a supporting structure installed adjacent to both side surfaces and a top surface of the large structure, and a carrying unit installed movable along the supporting structure to allow materials to be carried or to provide a working space for a worker thereon, wherein the supporting structure is installed to be movable along a wall surface of the large structure.

Preferably, the supporting structure comprises a pair of supporting posts spaced apart from each other by a predetermined distance and connected by a connecting member, and the carrying unit is installed between the pair of supporting posts to move along the supporting posts. The scaffold of the present invention may further comprise a plurality of rails installed along the wall surface of the large structure; and a movable support installed to the supporting structure and movable along the rails. In addition, the movable support may include a connecting block having two inclined surfaces inclined at an angle corresponding to a bent angle of the wall surface of the large structure; and a pair of wheels associated with the rails and rotatably installed to the inclined surface of the connecting block. Further, each of the rails may be formed of a cylindrical pipe. Preferably, each of the rails is installed on a surface of a corner structure that is installed at the corner of the large structure. The supporting structure may include a roller installed at a lower end thereof. Further, the supporting structure may include roller rails installed on opposite inner side surfaces of the pair of supporting posts, and the carrying unit may include movable roller units movably coupled respectively with the roller rails to guide movements of the carrying unit. Furthermore, each of the movable roller units may include a brackets installed at either side of a front or rear end of the carrying unit; a plate with a rotating shaft rotatably connected with the bracket; and a pair of rolling wheels each having a central shaft rotatably installed to the plate and being rolled on the roller rail. The movable roller unit may be installed to allow a gap between the carrying unit and the rolling wheels to be adjusted. Moreover, a plurality of rows of roller rails are installed, and the carrying unit may include a material cart installed to the roller rail adjacent to the large structure for carrying materials and a movable working platform installed to the roller unit far away from the large structure for allowing a worker standing thereon to perform desired work using the materials carried by the material cart. Here, the movable working platform may include a basket which is moved along the roller rails and provides a space for the worker, and a driving portion for causing the basket to be moved along the roller rails. Further, the movable roller units of the movable working platform may be composed of a first movable roller unit installed at an upper end of the basket to allow the basket to be rolled along the rolling rail, and a second movable roller unit spaced apart from the first movable roller unit to allow the basket to be rolled along the rolling rail.

An aspect of the present invention provides a method of constructing an insulation system, comprising the steps of (a) installing a supporting structure at a predetermined position on an inner wall of a large structure to be movable in a longitudinal direction of the large structure; (b) carrying a worker or materials along the supporting structure; and (c) installing the materials carried in step (b) to the inner wall of the large structure.

Here, step (a) may comprise the steps of installing a plurality of rails onto the inner wall of the large structure; installing a movable support movably coupled with the rail onto the supporting structure; and coupling the supporting structure to the large structure to be movable along the inner wall of the large structure by means of the movable support. Further, step (b) comprises the steps of linking a carrying unit, which carries materials or provides a working space for a worker, to the supporting structure; loading materials or carrying the worker on the carrying unit; and causing the carrying unit to be moved along the supporting structure and the loaded materials or carried worker to be moved at a working position. Furthermore, the supporting structure may include a pair of supporting posts spaced apart from each other by a predetermined distance and connected by a connecting member, roller rails may be installed on opposite inner side surfaces of the pair of supporting posts, and a material carrying device or a movable working platform for a worker may be installed on the rails.

DETAILED DESCRIPTION OF EMBODIMENTS

Hereinafter, various embodiments of the present invention will be described in detail with reference to the accompanying drawings.

Figure 1:
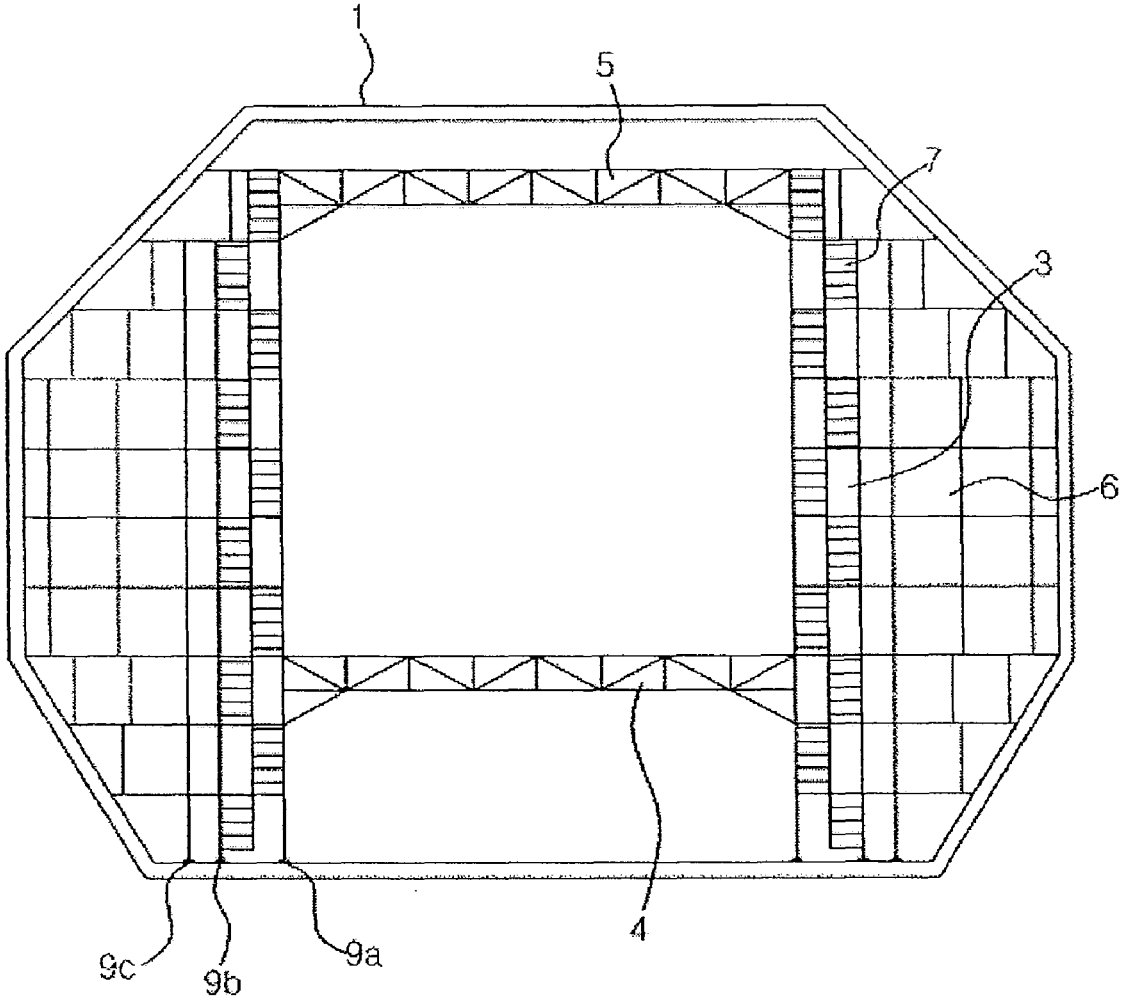
FIG. 1 is a schematic view illustrating a state where an exemplary scaffold is installed within a large structure.
Figure 2:
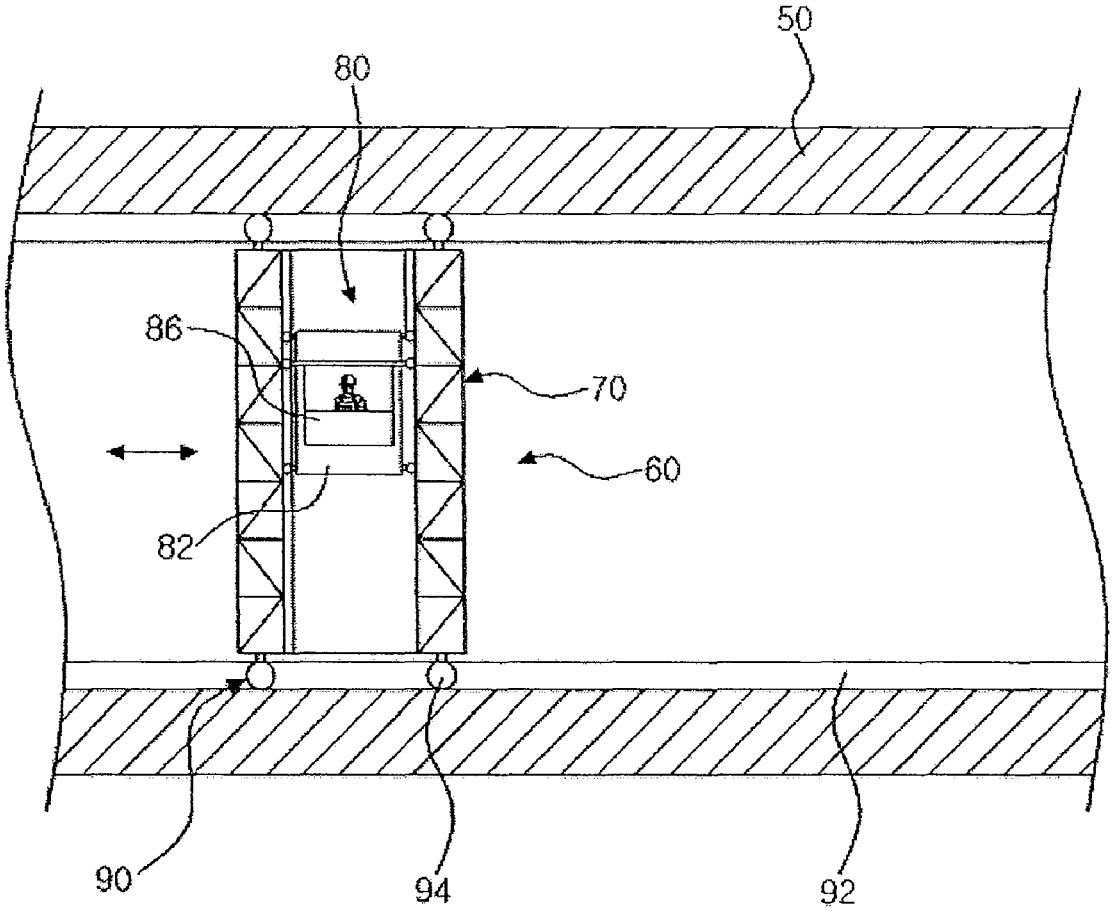
FIG. 2 is a schematic front sectional view illustrating a state where a scaffold according to an embodiment of the present invention is installed within a large structure such as an LNG tank of a ship.
Figure 3:
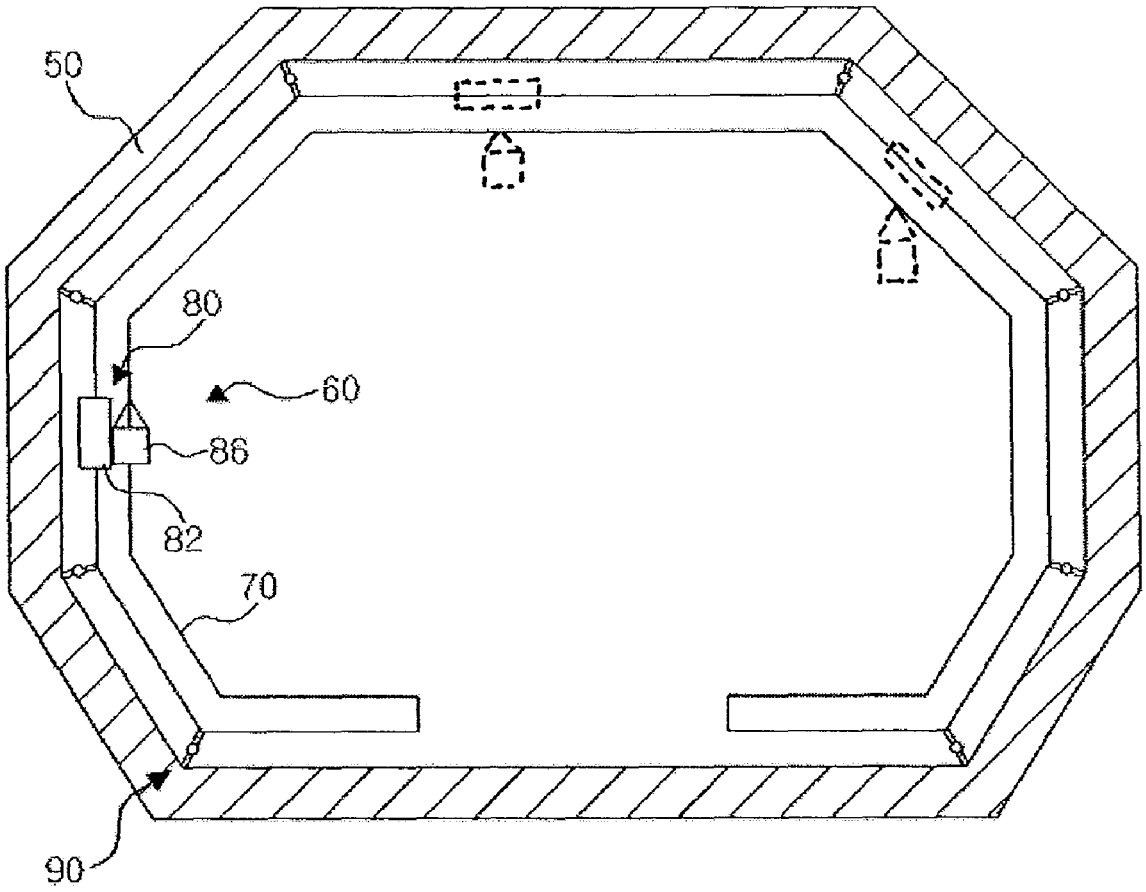
FIG. 3 is a schematic side sectional view illustrating a state where the scaffold according to an embodiment of the present invention is installed within the large structure.

FIGS. 2 and 3 are schematic front and side sectional views illustrating a state where a scaffold according to an embodiment of the present invention is installed in a large structure. A scaffold 60 according to an embodiment of the present invention includes a supporting structure 70 installed adjacent to both side surfaces and a top surface of an inner wall of a large structure 50 to provide desired internal work for the large structure. A rail 92 is installed within and fixed to the large structure 50 in a longitudinal direction thereof. The supporting structure 70 can be movably installed along the inner wall of the large structure 50 in a longitudinal direction thereof. To this end, the supporting structure includes a movable support 90. The movable support 90 a pair of wheels 94 associated with and engaged with the rail 92, so that the supporting structure 70 can be moved along the rail 92.

Further, a carrying unit 80 for carrying workers or materials is installed in the supporting structure 70. At this time, the carrying unit 80 is installed movable along the supporting structure 70 in a vertical direction to provide a space needed to carry materials or workers such that the worker can perform desired work for installing the carried materials to the wall of the large structure in a state where they stand thereon. That is, since the carrying unit 80 is moved along the supporting structure 70 in a height direction and the supporting structure 70 is also moved along the wall of the large structure in a longitudinal direction thereof, desired work can be performed on the whole surfaces of the inner wall of the large structure 50.

In addition, the scaffold 60 enables workers or materials to be carried individually along the supporting structure 70 and also the supporting structure 70 installed at a portion of the large structure 50 to be moved along the entire wall of the large structure 50 such that desired internal work can be performed on the wall. That is, the scaffold 60 does not have to be installed on the entire inner wall surface of the large structure 50. Therefore, an installation space of the scaffold can be saved, and manufacturing costs can be reduced since a small amount of time and materials is required to install the scaffold.

Figure 4:
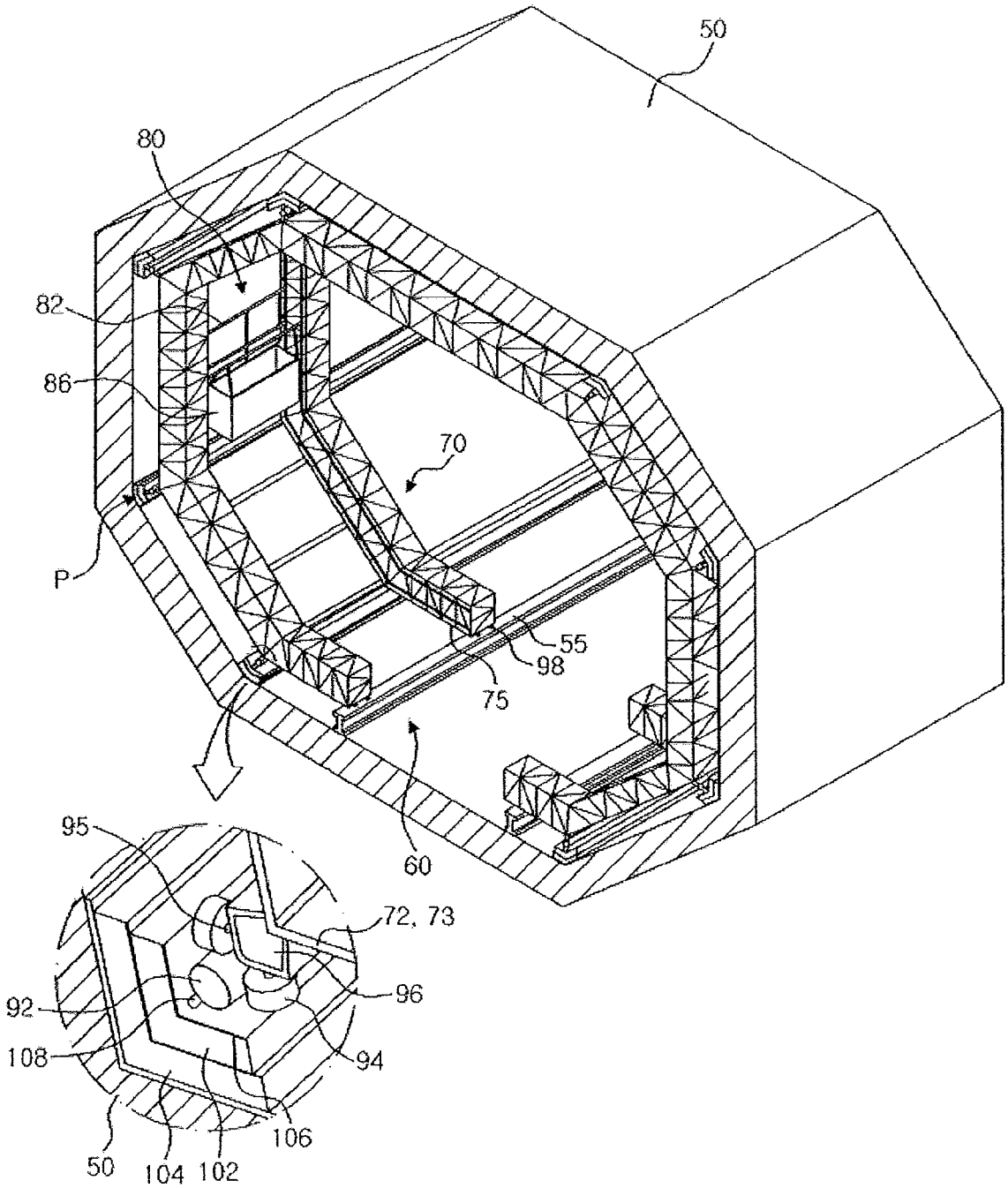
FIG. 4 is a perspective view illustrating a state where the scaffold according to an embodiment of the present invention is installed within the large structure.
Figure 5:
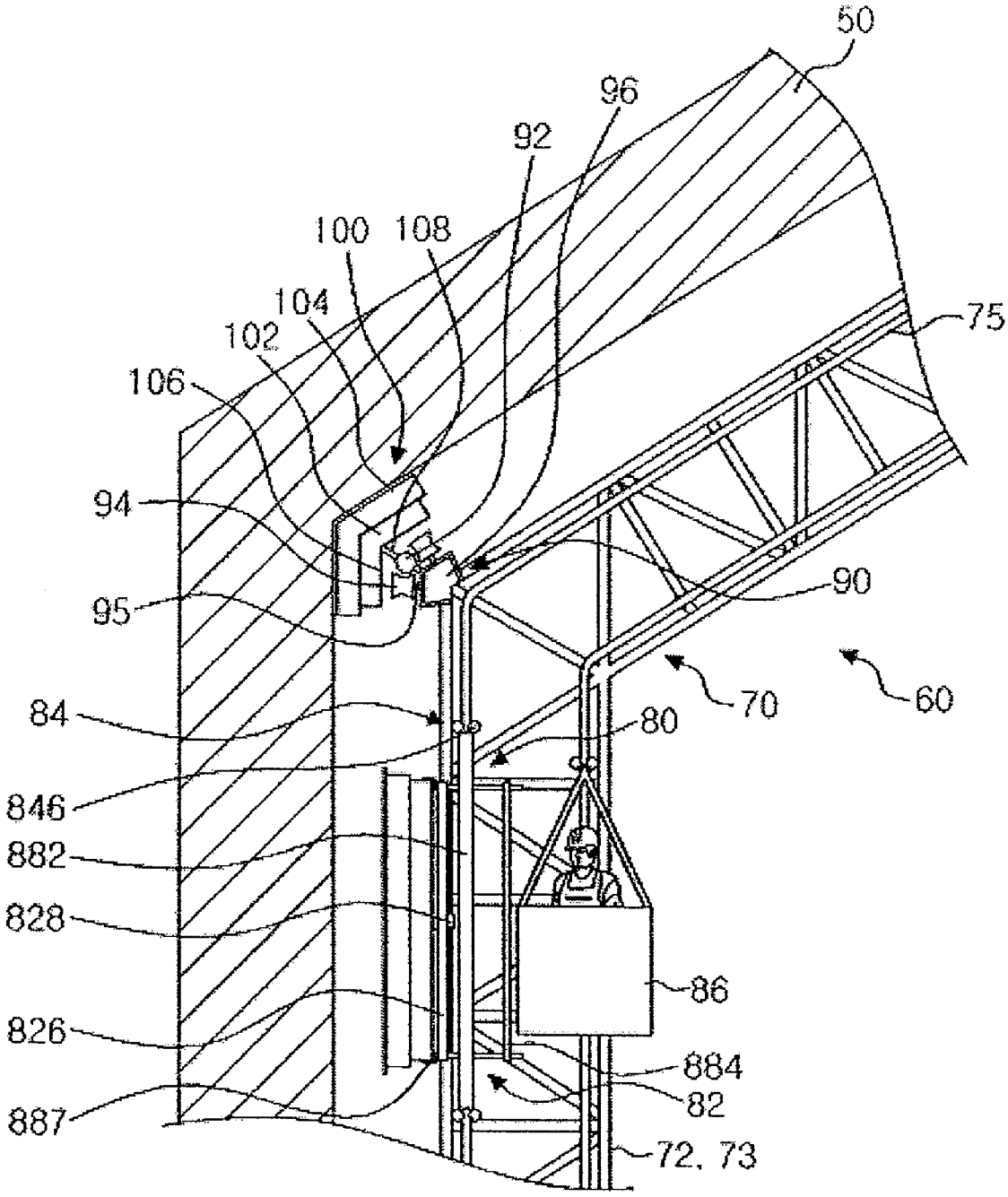
FIG. 5 is a partial side elevation view showing a state where the scaffold according to an embodiment of the present invention is installed within the large structure.

An embodiment of the present invention will be further explained in more detail with reference to FIGS. 4 and 5 which correspond to perspective and partial side elevation views, respectively, showing a state where the scaffold is installed within the large structure. The scaffold 60 provides a space for a worker and carries materials and working tools when the worker conducts desired work at a higher location to construct the large structure 50 such as a pressure vessel, a tank or a dome. In some embodiments, the scaffold is used in building a liquid tank, although not limited thereto. In certain embodiments, the scaffolding can be used in building a grain tank, a gas tank, a liquid container, a building, a tunnel, a ship and any other structure having interior space.

In an embodiment, an insulation system P for internal sealing is constructed on the inner wall of the unfinished large structure or unfinished liquid tank 50. To this end, the scaffold 60 for construction of the insulation system is set up. The scaffold 60 includes a supporting structure 70 installed adjacent to both side surfaces and a top surface of a large structure 50. Preferably, a movable support 90 for movably supporting the support structure 70 is installed between the support structure 70 and the large structure 50 and fixed to the large structure which may be removed after completion of building the liquid tank.

The movable support 90 includes a plurality of rail 92 installed on an inner wall of the large structure 50 such that the support structure 70 can be moved along the inner wall. Each of the rails 92 may be installed at corners or curved regions on the large structure 50. Preferably, the rail 92 may be installed on a surface of a corner structure 100 installed at the corner of the large structure 50.

The corner structure 100 includes a first insulating wall 102 for providing thermally insulating of a tank and a second insulating wall 104 placed below the first insulating wall. The corner structure 100 is configured in such a manner that a plate 106 is installed on the first insulating wall 102. In an embodiment, the plate 106 may be liquid tight. Further, a plurality of supporting portions 108 formed with screw holes are installed on the plate 106. Meanwhile, the rails 92 are closely placed on the supporting portions 108 in a state where bolts are fastened to the screw holes through the rails 92.

The movable support 90 includes a plurality of connecting blocks 96 each of which has two inclined surfaces inclined with respect to each other at an angle corresponding to a corner angle of the wall surface of the large structure. Further, supporting portions 95 are installed on the two inclined surfaces, respectively. In addition, a pair of wheels 94 associated with the rails 92 are rotatably installed to the supporting portions 95. At this time, the wheels 94 are seated on the rails 92 at specific angles determined in accordance with the angles of the inclined surface of the connecting blocks 96.

In the meantime, each of the rails 92 is formed of a hollow pipe, and is preferably formed into a cylindrical shape. When the rail 92 is formed into a cylindrical shape, a portion of the wheel 94 coming into contact with the rail 92 is formed to correspond to the shape of the rail 92 such that the wheel 94 cannot be easily separated from the rail 92.

Furthermore, rollers 98 may be installed to a lower portion of the supporting structure 70. Preferably, a guide 55 is installed to the bottom of the large structure 50 such that the supporting structure 70 can be moved in a state where the rollers 98 are securely seated in the guide 55.

As described above, the supporting structure 70 is movably installed by means of the movable support 90 and the rollers 98. Therefore, the supporting structure 70 can be slid along the inner wall of the large structure 50 to enable a worker to perform desired work on the whole inner wall of the large structure 50. Thus, in a case where the size of the large structure 50 is increased, the size of the supporting structure 70 and the length of the rail 92 can be increased to cope with the increased size of the large structure 50.

The supporting structure 70 may be moved manually by workers or automatically by a moving means installed to the movable support 90. Here, the moving means installed to the movable support 90 may include a motor (not shown) connected to drive the wheel 94. As the motor is operated, the wheel 94 is also rotated to cause the supporting structure 70 to be moved along the rails 92.

As described above, the scaffold 60 is configured in such a manner that the supporting structure 70 can be moved by causing the wheels 94 to be driven. However, the present invention is not limited thereto, and various modifications can also be made. As an example, the moving means may include a cable connected to the supporting structure 70 and the large structure 50, and a winding means for causing the supporting structure 70 to be moved. Alternatively, the scaffold 60 may also be moved using the moving means. Here, a pair of the winding means is preferably provided to pull the cable in opposite directions such that the supporting structure 70 can be moved in a specific direction when a force used to pull the cable in the specific direction is greater than the pulling force in the other direction.

The carrying unit 80 may include a material cart 82 functioning as a material carrying device for carrying materials, and a basket 86 functioning as a movable working platform on which a worker can perform desired work. The material cart 82 and the basket 86 may be operated individually. The worker standing on the basket 86 can install the materials carried on the material cart 82 onto the inner wall of large structure 50.

Figure 6:
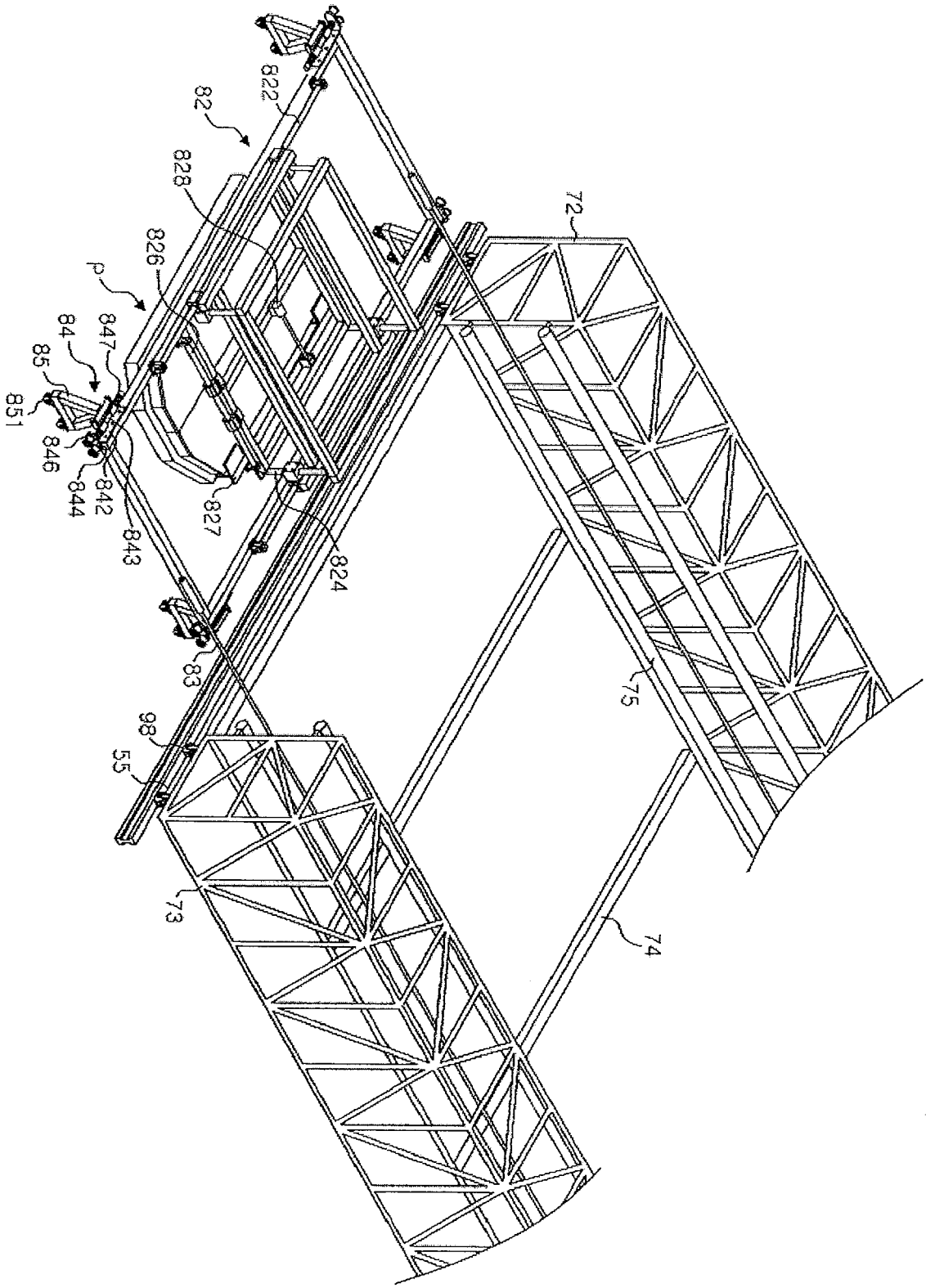
FIG. 6 is a schematic perspective view illustrating a state where a material carrying device of the scaffold according to an embodiment of the present invention is coupled to a supporting structure.
Figure 7:
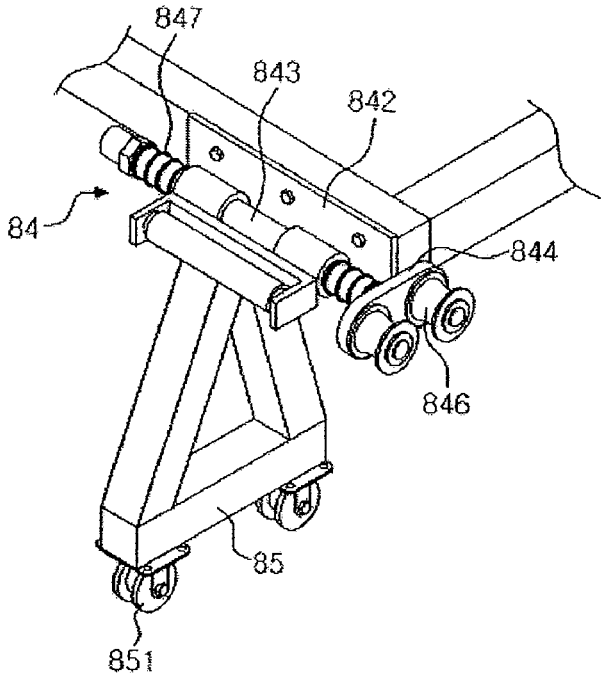
FIG. 7 is an enlarged perspective view showing a movable roller unit of the scaffold according to an embodiment of the present invention.

Referring to FIG. 6 corresponding to a schematic perspective view illustrating a state where the material carrying device is linked to the supporting structure in the scaffold and FIG. 7 corresponding to an enlarged perspective view of a movable roller of the scaffold, the supporting structure 70 includes two supporting posts 72 and 73 spaced apart from each other by a predetermined distance which are connected to each other by connecting members 74. The carrying unit 80 is coupled between a pair of supporting posts 72 and 73. The carrying unit 80 is installed between the pair of supporting posts 72 and 73 such that they can be moved along the supporting posts 72 and 73.

To this end, roller rails 75 are installed on opposite inner sides of the pair of the supporting posts 72 and 73 in the supporting structure 70. Each of the roller rails 75 is spaced apart from the supporting post 72 or 73 by a predetermined interval by means of a supporting member and installed along the supporting post 72 or 73 to have a gentle curvature such that the carrying unit 80 can be smoothly moved along the supporting posts 72 and 73. Here, the roller rails 75 may be installed in plural rows to allow the material cart 82 and the basket 86 to be moved along the rails, respectively.

The material cart 82 is installed to a roller rail 75 closer to the large structure 50, whereas the basket 86 is installed to a roller rail 75 farther away from the large structure 50. The basket 82 is installed behind the material cart 82 to provide a space where a worker can enter to perform desired work. The basket 86 is moved at a rear position of the material cart 82 to perform desired work using the materials carried from the material cart 82 in a state where a worker gets on the basket. More specifically, the material cart 82 is installed between the pair of the supporting posts 72 and 73. Further, the material cart 82 is composed of a material cart portion which moves along the roller rails 75 and can carry materials, and a driving portion for causing the material cart portion to be moved along the roller rails 75.

In addition, the material cart 82 includes movable roller units 84 installed at both sides thereof and is moved along the roller rails 75 using the movable roller units 84 fixedly installed thereto. At this time, brackets 842 of the movable roller unit 84 are installed at both sides of front and rear ends of the material cart 82 such that the material cart 82 can be stably moved along the roller rails 75. A plate 844 with a rotating shaft 843 is connected to each of the brackets 842. Further, the material cart 82 includes a pair of rolling wheels 846 rolling along the roller rails 75, and each of the rolling wheels 846 has a central shaft rotatably installed to the plate 844 to be adjusted.

At this time, the movable roller unit 84 is preferably installed to allow an interval between the bracket 842 and the rolling wheels 846. To this end, the rotating shaft 843 of the plate 844 extends further in a direction toward the bracket 842 and springs 847 are provided around the rotating shaft 843 at positions between an outer end of the rotating shaft 843 and the bracket 842 and between the plate 844 and the bracket 842, so that the movable roller unit 84 can be moved by a predetermined distance from side to side.

The material cart 82 is configured such that it is moved along its respective axes to carry materials and to install the carried materials to preset positions of the large structure 50. The material cart 82 has a first axis frame 822 to which the movable roller unit 84 is attached, and the first axis frame 822 is moved along the supporting posts 72 and 73 in a direction parallel to the inner wall of the large structure 50 by means of the movable roller unit 84.

A second axis frame 824 which intersects the first axis frame 822 in a direction parallel to the inner wall of the large structure 50 is installed to the first axis frame 822. Furthermore, a third axis frame 826 is movably installed to the second axis frame 824 in a direction perpendicular to the first and second axis frames 822 and 824. A clamp 827 for clamping the materials is also installed at the third axis frame 826. The clamp 827 is actuated by means of a driving motor 828 installed at the third axis frame 826. Further, the respective frames are mounted with driving units (not shown) for moving the axis frames in respective axis directions.

Furthermore, the material cart 82 includes a leveling unit 85 for adjusting a height from the floor surface to place the movable roller unit 84 onto the roller rail 75. The leveling unit 85 may include wheels 851 used to allow the material cart 82 to be rolled along the floor surface of the large structure 50 and also to be initially placed onto the supporting post 72 and 73. Preferably, the leveling unit 85 is preferably configured such that the height spaced apart from the floor surface can be adjusted. It is also possible to separate the leveling unit 85 from the material cart 82 after placing the material cart onto the supporting posts 72 and 73.

Furthermore, the scaffold 60 also includes a moving means for lifting and moving the aforementioned material cart 82, and the moving means is installed such that the material cart 82 can be automatically lifted or lowered along the supporting structure 70. To this end, a cable 83 is connected to the supporting structure 70 and the material cart 82, and a winding means (not shown) for winding the cable 83 to move the material cart 82 is installed.

Figure 8:
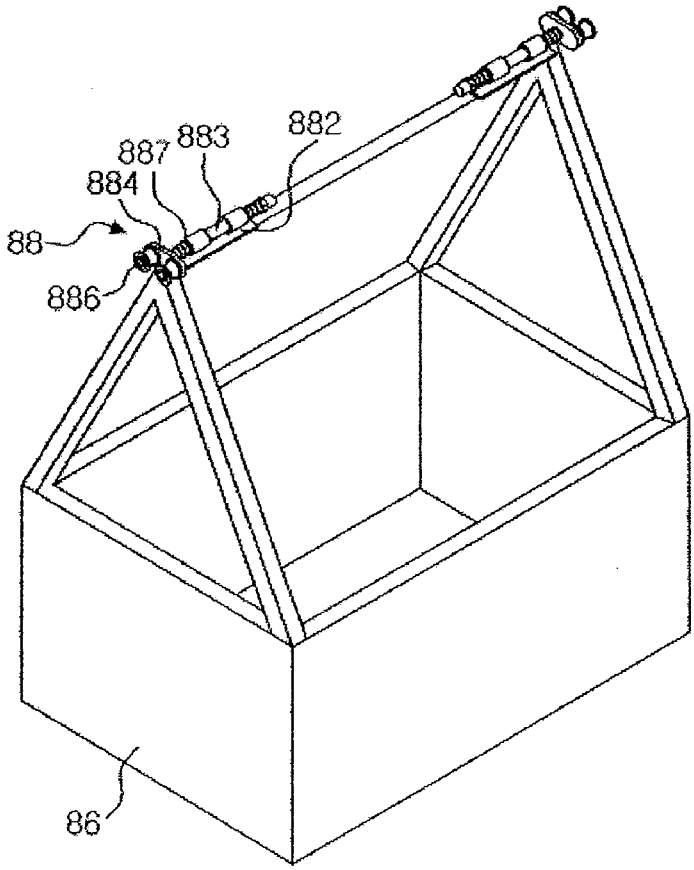
FIG. 8 is a perspective view showing a movable working platform of the scaffold according to an embodiment of the present invention.

FIG. 8 is a perspective view showing a movable working platform of the scaffold according to an embodiment of the present invention. The movable working platform comprises the basket 86 which is installed between the pair of supporting posts 72 and 73 and moved along the roller rails 75 to allow a user to get thereon, and a driving portion for causing the basket 86 to be moved along the roller rails 75.

Basket moving roller units 88 are installed at both sides of the basket 86. Each of the basket moving roller units 88 has the same structure as the movable roller unit 84 of the material cart 82. The basket 86 is rolled along the roller rails 75 by means of the basket moving roller units 88. At this time, brackets 882 of the basket moving roller unit 88 are installed at both sides of upper ends of the basket 86 such that the basket 86 can be stably moved along the roller rails 75. A plate 884 with a rotating shaft 883 is connected to each of the brackets 882. Further, the basket 86 includes a pair of rolling wheels 886 rolling along the roller rails 75, and each of the rolling wheels 886 has a central shaft rotatably installed to the plate 884.

At this time, the basket moving roller unit 84 is preferably installed to allow an interval between the bracket 882 and the rolling wheels 846 to be adjusted. To this end, the rotating shaft 883 of the plate 884 extends further in a direction toward the bracket 882 and springs 887 are provided around the rotating shaft 883 at positions between an outer end of the rotating shaft 883 and the bracket 882 and between the plate 884 and the bracket 882. Therefore, the basket moving roller unit 88 can be moved by a predetermined distance from side to side, and thus, the connection between the basket 86 and the roller rails 75 can be easily made.

Although it has been described in the above discussed embodiment of the present invention that a single basket moving roller unit 88 is installed at each side of the basket 86, a plurality of basket moving roller units 88 may be installed at each side of the basket 86 so that the basket 86 can be more stably coupled to the supporting structure 70. The lower and upper basket moving roller units 88 installed at each side of the basket 86 are spaced apart from each other by a predetermined distance, and are arranged to form an angle corresponding to an angle defined by the inner wall of the large structure 50.

Here, a worker get on the basket 86 to perform desired work for installing materials carried on the material cart 82 onto the inner wall of the large structure 50. Further, the material cart 82 or basket 86 can carry an automatic welding apparatus for bonding an insulation system P with other adjacent insulation systems P, and then, the worker can install the automatic welding apparatus at a desired position to perform desired insulation system welding work. Furthermore, the movable working platform includes a moving means to move the basket 86. The moving means is composed of a cable connected to the supporting structure 70 and the material cart 82, and a winding means for winding the cable to move the basket 86.

Figure 9:
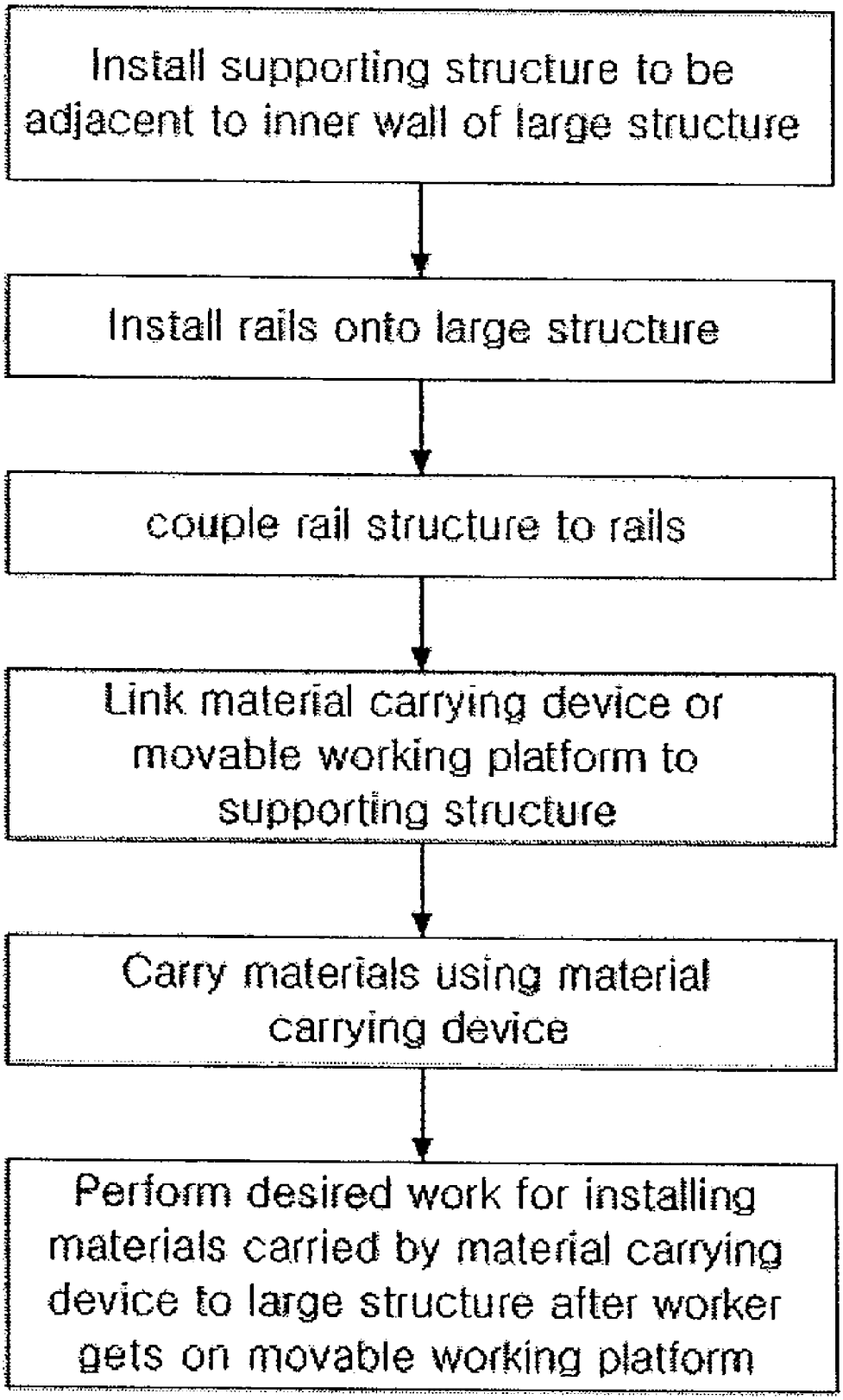
FIG. 9 is a block diagram illustrating a process of constructing an insulation system using the scaffold according to an embodiment of the present invention.

FIG. 9 is a block diagram illustrating a process of constructing an insulation system using the scaffold according to an embodiment of the present invention. The insulation system construction method using the scaffold will be explained with reference to FIG. 9.

The insulation system construction method using the scaffold 60 comprises the steps of (a) movably installing a supporting structure 70 at a desired position on an inner wall of a large structure 50 in a longitudinal direction of a tank, (b) moving the installed supporting structure 70 along the inner wall of the large structure 50, and (c) installing materials carried in step (b) onto the inner wall of the large structure 50.

More specifically, in step (a), the supporting structure 70 is first installed adjacent to both side surfaces and a top surface of the inner wall of the large structure 50 to perform desired internal work for the large structure 50 such as a pressure vessel, a tank or a dome, and is then movably installed along the longitudinal direction of the large structure 50. The supporting structure 70 is constructed by forming a pair of supporting posts 72 and 73 to be adjacent to the inner wall of the supporting structure 70 and then connecting the pair of posts with each other using connecting members 74 to become an integral structure.

Next, supporting portions 108 are installed at curved regions on the inner wall of the large structure 50, and a plurality of rails 92 are installed at the supporting portions 95 108. To this end, bolts penetrating through the rails 92 are fastened to the supporting portions 108. At this time, the rails 92 are formed to extend along the inner wall of the large structure 50. Preferably, corner modules are first installed at corner regions and the like of the large structure 50 and the rails 92 are installed onto the corner modules. In a case where the large structure 50 is curved, the supporting structure 70 is preferably formed to have a gentle curvature such that a carrying unit 80 including a material cart 82 and a basket 86 can be smoothly moved.

Then, a movable support 90 is installed to one side of the supporting structure 70 such that a pair of wheels 94 can be movably coupled with the rail 92. The supporting structure 70 can be moved by means of the movable support 90 in such a manner that the pair of wheels 94 is rolled along the rail 92. Therefore, the supporting structure 70 can be movably supported by the movable support 90 including the rail 92 and the pair of wheels 94, and then can be moved along the entire inner wall of the large structure 50.

A step of carrying the materials or workers can be achieved by using the material cart 82 (i.e., a material carrying device) and the basket 86 for the workers, which are installed on the supporting structure 70. Thus, a process of installing an insulation system P onto the inner wall of the large structure can be performed by using the material cart 82 and the basket 84, respectively, on which the working materials and workers are carried. Here, the material cart 82 is mounted to the supporting structure to be movable in a vertical direction and thus to allow the materials to be carried onto desired working positions. Further, in the step of carrying the materials or workers, the basket 86 is installed to supporting structure 70 to be movable in a vertical direction and is placed at a rear position of the material cart 82, so that the worker can perform desired work for the carried materials.

To this end, a plurality of roller rails 75 are installed on inner sides of the supporting structure 70, i.e. opposite surfaces of the pair of supporting posts 72 and 73, respectively. At this time, the material cart 82 on which materials are carried is installed between the roller rails 75, whereas the basket 86 on which the worker gets to perform the desired work is installed between the other roller rails 75. This is because the worker on the basket 86 can easily install the materials carried by the material cart 82, e.g. the insulation system P for sealing the inner wall of the large structure 50, to the inner wall of the large structure 50. Further, since the worker is positioned behind the materials, the worker can perform the desired work for installing the insulation system P onto the inner wall in a state where he/she gets on the basket 86.

Further, the step of installing materials onto the inner wall of the large structure is a step of carrying the insulation system P to the carrying unit 80 and then installing the carried insulation system P onto the inner wall of the large structure 50. As described above, the scaffold 60 so configured can be used to perform desired work on the large structure 50 at lower and higher places since the supporting structure 70 can be installed to be automatically moved along the rails 92 of the large structure 50 and the material cart 82 and the basket 86 can be freely moved up and down within the supporting structure 70.

In the meantime, the material cart 82 of the carrying unit 80 vacuum holds the insulation system P and then moves the insulation system to a position adjacent to the inner wall of the large structure 50, whereas the basket 86 carries a worker to a position where the material cart 82 is placed. As described above, the worker and materials are moved along the supporting structure 70 to a location where desired work will be performed. In such a way, the insulation system P can be installed throughout the entire inner wall of the large structure.

Although a scaffold and an insulation system construction method using the same according to an embodiment of the present invention have been explained with reference to the accompanying drawings, the present invention is not limited to the illustrated embodiment and drawings. It is apparent to those skilled in the art that various modifications and changes can be made.

The insulation system construction method according to an embodiment of the present invention can be applied to an LNG cargo tank and also to a large ground structure such as a vessel pressure, a tank or a dome. Although it has been described in the embodiment of the present invention that the rail is provided and the movable support includes a pair of wheels movably coupled to the rail, the present invention is not limited thereto and various modifications can be made thereto. As an example, the supporting structure 70 can be moved by means of a cylinder which can be stretched and contracted by the hydraulic or pneumatic force. An additional moving vehicle may also be utilized to move the supporting structure. Further, the wheels of the movable support may be engaged in mesh with the rail, so that the rail and wheels of the movable support can be moved without any slippage. Preferably, a motor used in the movable support may also be a step motor capable of adjusting the moving degree of the supporting structure.

In the scaffold and the insulation system construction method using the scaffold according to an embodiment of the present invention, since the scaffold can be moved along the inner wall of the large structure, desired work in the large structure can be more easily and rapidly performed and a space required for the scaffold installation can be minimized. Further, even in a case where the size, and particularly length, of the large structure is increased, all the work in the large structure can be performed by merely increasing the length of the rails supporting the supporting structure, since the supporting structure can be configured to be movable along the rails. In addition, since it is not necessary to increase the size of the supporting structure, the durability and stability thereof can also be improved. Furthermore, since the materials can be automatically carried and a working space for the worker can be moved up and down, the working speed can be improved.

Also, since the configuration of the scaffold is simplified, the scaffold can be easily installed and removed.

What is claimed is:

1. A method of building a liquid tank, the method comprising:

providing a structure comprising a plurality of walls, which define an interior space, the plurality of walls comprising a first sidewall, a second sidewall, and a top wall;

installing a first insulation module on the first sidewall;

installing a plurality of guide rails extending in a first direction within the interior space, wherein a first one of the plurality of guide rails is installed over the first insulation module such that the first insulation module is interposed between the first guide rail and the first sidewall;

providing a scaffolding within the interior space;

engaging the scaffolding with the guide rails such that the scaffolding is slidable within the interior space along the guide rails;

sliding the scaffolding within the interior space along the guide rails;

installing second insulation modules over the first sidewall and next to the first insulation module, thereby building an insulation wall structure on the first sidewall, wherein the insulation wall structure comprises the first insulation module and the second insulation modules; and subsequent to building the insulation wall structure, removing the guide rails from the interior space, wherein the first insulation module is installed before engaging the scaffolding with the guide rails, wherein the second insulation modules are installed after engaging the scaffolding with the guide rails.

2. The method of claim 1, providing the scaffolding comprises building the scaffolding within the interior space.

3. The method of claim 1, further comprising removing the scaffolding from the interior space.

4. The method of claim 1, wherein the top wall interconnects the first sidewall and the second sidewall which generally opposes the first sidewall, wherein the first sidewall, the second sidewall and the top wall together define the interior space.

5. The method of claim 4, wherein the insulation wall structure is formed on the first sidewall, wherein the insulation wall structure comprises a metallic plate and an insulation material interposed between the metallic plate and the first sidewall, wherein the metallic plate comprises a plurality of metallic pieces that are liquid tightly coupled together so as to form the metallic plate.

6. The method of claim 4, wherein the first sidewall comprises two or more sidewall sections, each of which comprises an interior surface, wherein the interior surfaces of the two or more sidewall sections are angled with each other.

7. The method of claim 4, wherein the top wall comprises two or more top wall sections, each of which comprises an interior surface, wherein the interior surfaces of the two or more top wall sections are angled with each other.

8. The method of claim 4, wherein the scaffolding comprises a first side section, a second side section and a top section, wherein the top section interconnects the first side section and the second side section generally opposing the first side section.

9. The method of claim 8, wherein the first side section or the top section comprises two or more segments, each of which extends at an angle with respect to neighboring one thereof.

10. The method of claim 8, wherein the top section generally extends in a horizontal direction perpendicular to the first direction.

11. The method of claim 8, wherein the first side section is configured to move substantially parallel to an interior surface of the first sidewall when the scaffolding moves in the first direction.

12. The method of claim 8, wherein the top section is configured to move substantially parallel to a surface of the top wall when the scaffolding moves in the first direction.

13. The method of claim 8, further comprising:

providing a carrier configured to transfer a material between the first side section and the top section of the scaffolding; and moving the carrier relative to the scaffolding.

14. The method of claim 13, wherein the carrier is configured to move along the top section in a horizontal direction perpendicular to the first direction.

15. The method of claim 13, further comprising:

providing a second carrier configured to transfer a material between the first side section and the top section of the scaffolding; and moving the second carrier relative to the scaffolding.

16. The method of claim 13, wherein the first side section comprises two substantially parallely extending portions, and wherein the carrier is configured to be interposed between the two substantially parallely extending portions.

17. The method of claim 15, wherein the carrier is configured to move along a first path and the second carrier is configured to move along a second path substantially parallel to the first path.

18. The method of claim 17, wherein the first and second paths are configured such that the carrier can be interposed between the first sidewall and the second carrier.

19. The method of claim 4, further comprising:

providing a carrier configured to transfer a worker or a material along a path generally parallel to an interior surface of one of the first sidewall, the second side wall and the top wall; and moving the carrier along the path.

20. The method of claim 4, wherein the structure is located on the ground.

21. The method of claim 20, wherein the first sidewall, the second sidewall, the top wall and the ground define the interior space.

22. The method of claim 4, wherein the structure comprises a bottom wall opposing to the top wall and connected to the first sidewall, wherein the first sidewall, the second sidewall, the top wall and the bottom wall define the interior space.

23. The method of claim 5, wherein the insulation wall structure formed on the first sidewall and the top wall comprises metallic interior surfaces.

24. The method of claim 1, wherein the scaffolding comprises:

a pair of frames interconnected with each other, each frame comprising:

a first side section, a second side section generally opposing the first side section, and a top section interconnecting the first side section and the second side section;

a pair of sliding guides, each of which is installed onto each of the frames; and a carrier configured to slide along the sliding guides for transferring materials move a worker or material between different locations the first side section and the top section of the scaffolding.

25. The method of claim 24, wherein each of the sliding guides comprises a first side section, a second side section and a top section, which are respectively installed onto the first side section, the second side section and the top section of each of the frames.

26. The method of claim 24, wherein the sliding guide is located adjacent to a surface of one of the plurality of walls.

27. The method of claim 8, wherein the top section is located adjacent to the top wall.

28. The method of claim 8, wherein the scaffolding further comprises a bottom section generally opposing the top section.

29. The method of claim 8, wherein at least one pair of the guide rails are installed onto two generally opposing surfaces of the interior space, wherein the at least one pair of guide rails installed onto the generally opposing surfaces prevents substantial movement of the scaffolding in a direction extending between the two generally opposing surfaces while sliding the scaffolding along the guide rails.

30. The method of claim 1, further installing a third insulation module on the first sidewall, wherein a second one of the plurality of guide rails is installed over the third insulation module on the first sidewall such that the third insulation module is interposed between the second guide rail and the first sidewall, wherein the second insulation modules are installed between the first insulation module and third insulation module.

31. The method of claim 6, wherein the first insulation module is installed on the first sidewall where two sidewall sections connect at an angle therebetween.

32. The method of claim 1, wherein the first insulation module comprises two thermal insulation layers and a liquid tight material layer.

* * * * *